United States Patent [19]

Kramer et al.

[11] 4,074,841

[45] Feb. 21, 1978

[54] METHOD AND APPARATUS FOR FLOATATION CONVEYANCE OF STRIP MATERIALS

[76] Inventors: Carl Kramer, Am Chorusberg 8, Aachen; Heinrich Stein, Roermonder Str. 138b, Aachen-Laurensberg; Hans Joachim Gerhardt, Ruhrstr. 12, Loevenich, all of Germany

[21] Appl. No.: 749,109

[22] Filed: Dec. 9, 1976

[30] Foreign Application Priority Data

Dec. 15, 1975 Germany ..... 2556442

[51] Int. Cl.[2] ..... B65H 17/32

[52] U.S. Cl. ..... 226/97; 34/156

[58] Field of Search ..... 226/7, 97; 34/156

[56] References Cited

U.S. PATENT DOCUMENTS

| | | | |
|---|---|---|---|
| 3,384,282 | 5/1968 | Vits | 34/156 X |
| 3,587,177 | 6/1971 | Overly | 34/156 |
| 3,763,571 | 10/1973 | Vits | 226/97 X |

*Primary Examiner*—Richard A. Schacher

*Attorney, Agent, or Firm*—Meyer, Tilberry & Body

[57] ABSTRACT

A method and apparatus is provided to convey materials in strip form by air pressure floatation. Plenums are provided along the path of floatation to alternately create positive and negative air pressure support areas which induce a wave-like conveying motion to the strip.

3 Claims, 4 Drawing Figures

METHOD AND APPARATUS FOR FLOATATION CONVEYANCE OF STRIP MATERIALS

Figure 1:
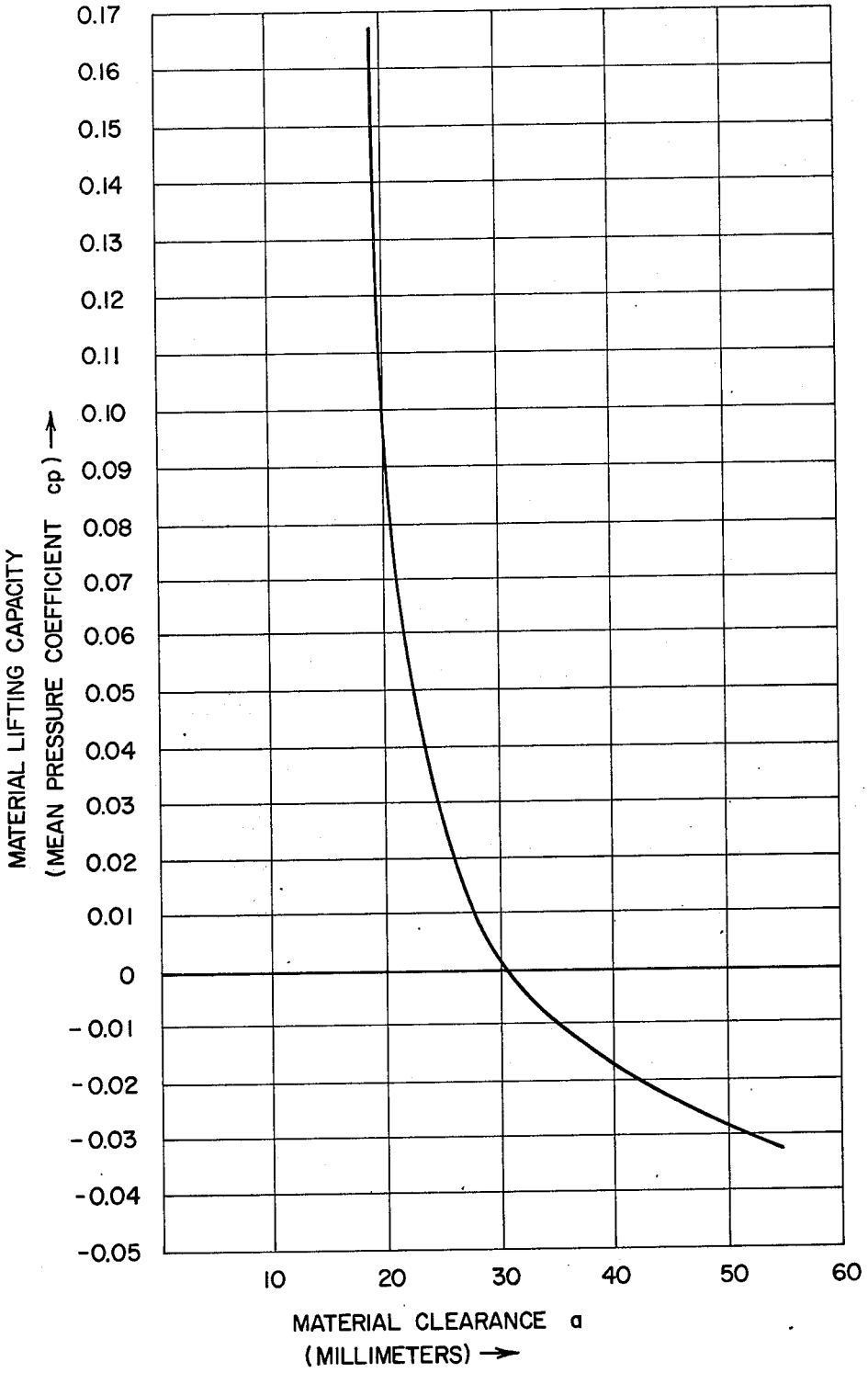

Known methods for floatation guidance of material webs or strips such as textiles, paper, plastic, metal or the like generally are divided between techniques for supporting heavy strips and techniques for supporting light strips.

In heavy strip floatation, systems are available with high lifting capacity essentially achieved by the establishment of gas cushions or pillows between an air nozzle system and the material. However, the jet forces acting normally upon the material are so great that such an application for light weight strips, and in particular foils, is not feasible. To support light weight material strips, nozzle systems are employed whose gas jets are to a large extent tangentially directed toward the material. In this manner, the vector of the jet impulse acting perpendicularly to the light weight strip material can be kept relatively small, thereby avoiding excessive vaulting of the material. Nevertheless, with a system employing tangential jet forces there is a tendency for the strip to flutter, requiring special precautions to be taken in the case of very light strips.

For instance, in the West German patent art, Dt-OS 1,954,880 discloses a method in which the gas jet comes from a nozzle arranged at right angles to the strip and is then deflected by a profiled surface element to direct the gas flow at a very small distance from the surface to be treated, such as in the order of 1 mm. The steady guidance of the strip is essentially determined by the accurate dimensioning of the nozzle slots and by proper coordination of the dimensions of the profiled surface element to the nozzle slots. With such a small clearance between the strip and the nozzle, unserviceable for many applications, small changes in the shape and/or width of the nozzle slot have a considerable effect on the strip.

West German DT-OS 1,774,126 discloses a nozzle system in which nozzle ribs in the area facing the material web are formed in the profile of an airfoil wing. In addition to the high cost of manufacturing this kind of nozzle rib, because of the small clearance between the strip and the nozzle system, this construction has the further disadvantage that a steady and flutter free floating guidance is not obtainable with a unilateral blast.

Finally, from West German DT-OS 1,938,529 a device is known for the guidance of a moving strip which consists essentially of an air nozzle with the cross section of a flat rectangular channel from which air is discharged in the direction of the goods and sweeps tangentially over a venturi surface arranged behind the nozzle. The vertical clearances of the nozzle duct slots are in this construction limited to relatively small values, such as 0.76 cm maximum. This is disadvantageous for the usual application, because in the case of such small slots the usually desired high heat transfer capacity as well as a sufficient carrying capacity can be achieved only with relatively high air velocities which in return require a highly efficient air impeller means. Also in the case of this nozzle system the disadvantages already mentioned above are inherent since the clearance between the strip and the venturi surface is very small. It is also not possible to construct the nozzle with a venturi surface which has a greater clearance from the strip than the boundary of the nozzle channel facing the material web, whereby the distance between strip and venturi surface would be enlarged, since with a greater clearance a carrying capacity no longer exists.

It can therefore be established that the essential disadvantage of the nozzle systems described hereinabove, as well as other prior art nozzle systems not discussed here in detail, for the floating guidance of strips of light material lies in the fact that, for the desired steady supporting behavior of the strip, the gas jet discharged tangentially to the web has to be guided in its immediate proximity by means of a guide surface which has a smooth, rounded shape or that of an airfoil wing profile. The small clearance required between strip and guide surface excludes the application of these known methods in many fields, particularly in view of the high cost of fabrication of precision airfoil guides.

It is therefore an object of this invention to provide a method and apparatus for floatation of light weight materials in which the disadvantages of the above described prior art are overcome.

It is a particular object of this invention to provide a light weight material floatation system in which thin sensitive webs or strips can be steadily guided for long distances.

It is another object of this invention to provide a material floatation system in which a tagential flow of gas is interrupted beneath a small clearance of a light weight material wherein a zone of high pressure is produced.

It is another object of this invention to provide a light weight material floatation system in which plenums may be positioned on either side of the material or on both sides of the material.

It is another object of this invention to provide a material floatation system wherein thin sensitive strips or webs may be supported by nozzles at a greater distance from the material than prior art systems.

It is another object of this invention to provide a material floatation system advantageously utilizing a zone of high pressure followed by a zone of low pressure.

It is another object of this invention to provide a material floatation system which induces a wave type motion in a strip material wherein undesirable canoeing of the strip material is diminished or eliminated.

It is another object of this invention to provide a material floatation system in which a plane anterior nozzle is arranged parallel to the strip being conveyed and a guide surface is provided upwind of the anterior nozzle wherein, by considerable widening of the cross section between the nozzle and the guide surface, detachment of the tangential flow of gas from the nozzle is achieved by virtue of the inclination of the guide surface.

It is another object of the invention to provide a material floatation system in which jet nozzles can be constructed for considerably less cost than a prior art guide surface in the shape of an airfoil wing profile.

It is another object of the invention to provide a material floatation system in which very high heat transfer coefficients can be achieved by the employment of spoilers to provide high monocellular turbulence of the jet stream used for material floatation.

It is another object of the invention to provide a material floatation system in which jet or mechanical spoilers may be employed to increase monocellular turbulence of gas beneath the material being floated.

It is another object of the invention to provide a material floatation system in which a jet stream spoiler is shiftable to vary the zone of higher pressure beneath the material, whereby the lifting capacity clearance relationship of the system may be accurately adjusted.

It is another object of the invention to provide a material floatation system in which an adjustable spoiler makes possible the use of inexpensive mass produced nozzles which are readily adjusted by said spoiler.

With the foregoing and other objects and features of the invention which will become evident from a reading of this specification, the invention consists of certain novel features of design and arrangement as illustrated in the accompanying drawings, and particularly pointed out in the appended claims, it being understood that various changes in the form, proportion, size and minor details of the invention may be made without departing from the spirit, or sacrificing any of the advantages of the invention.

For the purpose of facilitating an understanding of the invention, there is illustrated in the accompanying drawings a preferred embodiment thereof, from an inspection of which when considered in connection with the following description, the invention, its mode of construction, assembly and application and many of its advantages, will be readily understood.

Figure 2:
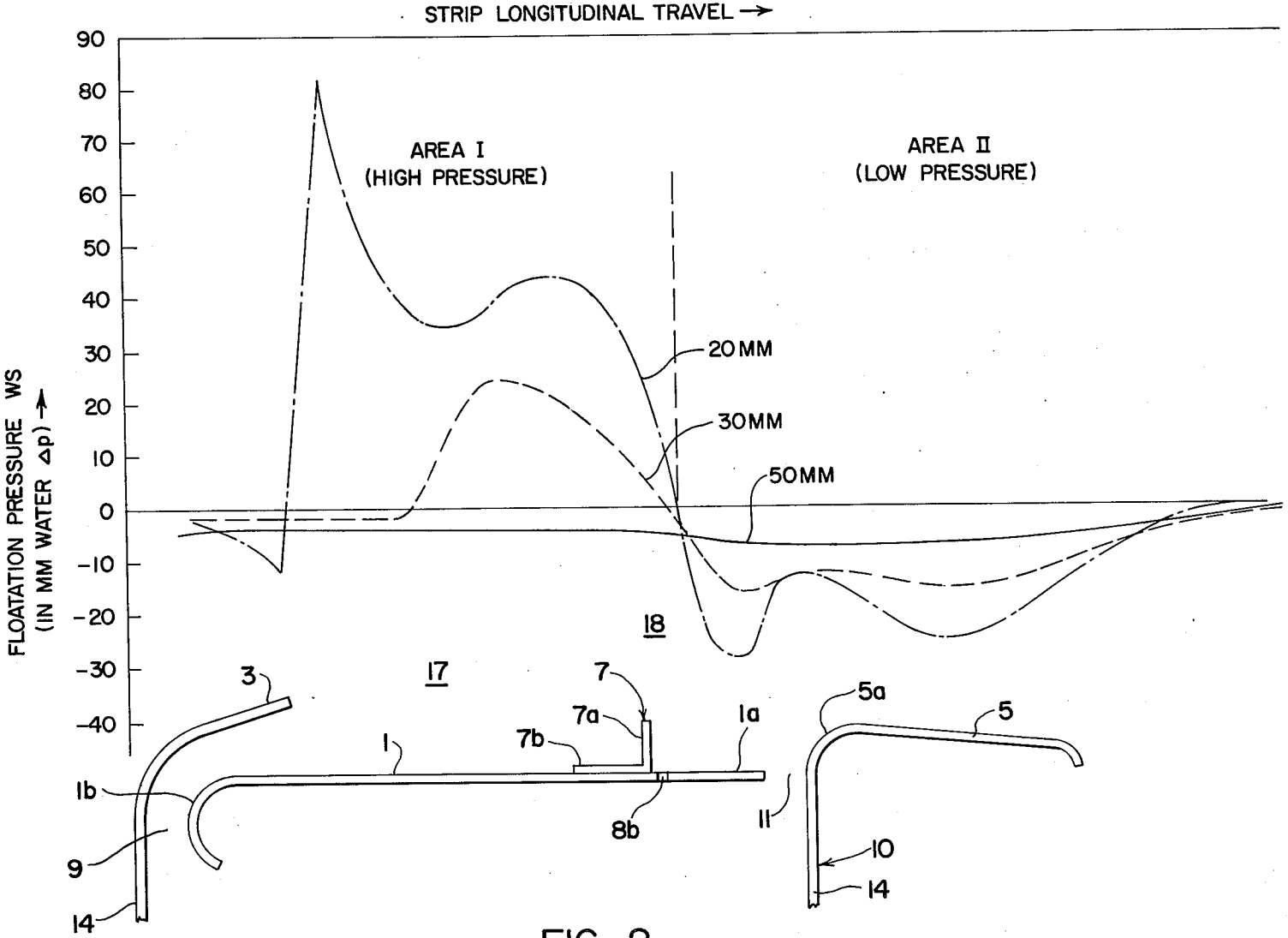
Figure 3:
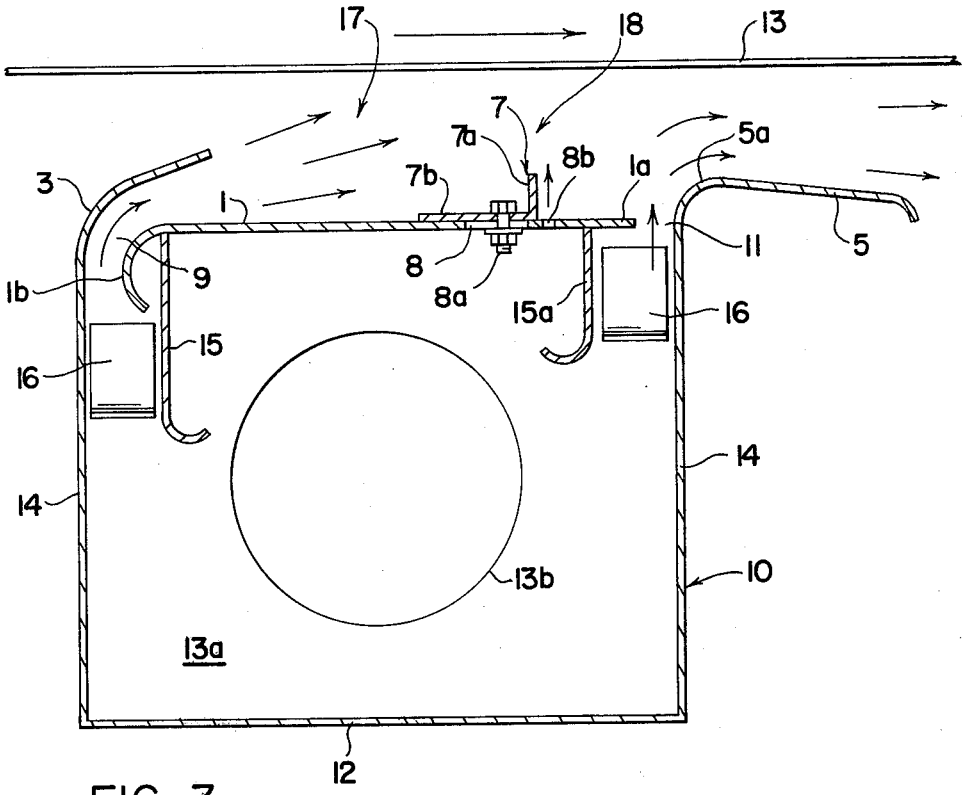
Figure 4:
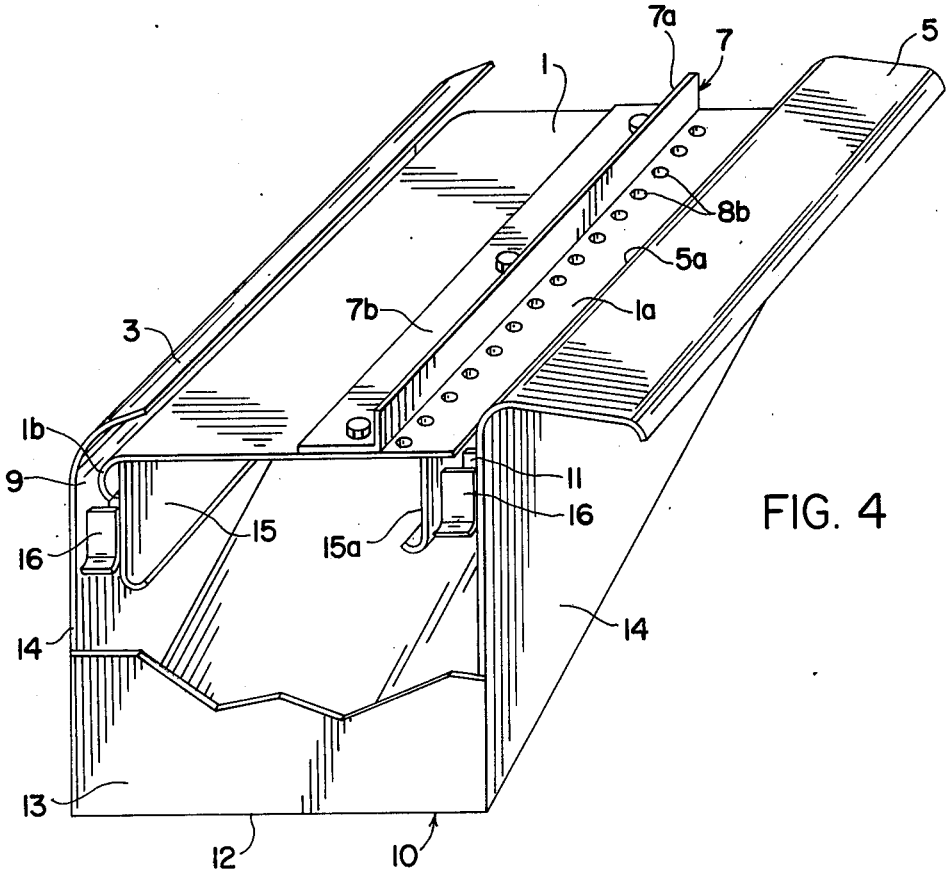

Reference is now made to the drawings in which the same characters of reference are employed to indicate corresponding or similar parts throughout the several Figures of the drawings, in which:

FIG. 1 is a curve in which lifting capacity is plotted against material clearance in a preferred embodiment of the invention;

FIG. 2 comprises a plurality of curves in which floatation pressures are plotted against strip longitudinal travel;

FIG. 3 is an elevational view in section of a preferred embodiment of the invention; and, FIG. 4 is a perspective view of the preferred embodiment of the invention also shown in section in FIG. 3.

Reference will now be made to the drawings in greater detail. In FIG. 1 is shown a curve in accordance with the invention graphically illustrating material lifting capacity along the vertical coordinate versus material clearance along the horizontal coordinate. It will be seen that the resultant force acting upon the material is a function of the distance of the material from the nozzles measured in millimeters along the horizontal coordinate. The force-distance parameters of FIG. 1 are met by the present invention with the plenum and nozzle system shown in FIGS. 3 and 4, wherein a plenum 10 includes a base plate 12 and vertical side plates 14. Vertically spaced apart from bottom plate 12 is a top plate 1, which in turn is spaced apart from side plates 14 to define transverse nozzle slots 9 and 11. End plate 13, shown partially in section in FIG. 4, encloses one end of plenum 10, and the opposite end is enclosed with end plate **13*a* and duct work 13*b* connected to a blower, not shown. According to the representation in FIG. 3, nozzle 9 is formed by the curved edge 1*b* of the top plate 1 and a curved elongation of the left side plate 14. Thereby is produced a guide surface 3 acting as a capping which extends over the curved edge 1*b*. The guide surface 3 is inclined against the top plate 1 at an angle between 10° and 30° from the horizontal. The radius a surface 3 is between 30 and 50 mm, from which extends a straight portion approximately 10 to 30 mm in length. Curved edge 1*b*** is rounded off on its front edge with a radius between 5 and 15 mm. Thereby is produced a slot-shaped nozzle orifice with a width between 2mm and 16mm.

Top plate 1 is completely flat and parallel to the material web 13 which is conveyed from left to right, as shown by the arrow in FIG. 3. On the top plate 1 is a spoiler 7 which can be formed, for instance, by an angle iron whose leg **7*b* is slidably fastened to top plate 1. The other leg 7*a* extends upwardly normal to top plate 1, toward the material web 13 and extends transversely to the traveling direction of the web 13, and is equal in width to top plate 1 between end plates 13 and 13*a*. In the preferred embodiment of the invention, the distance of the spoiler 7 from curved edge 1*b* is between 40 to 100 mm. The spoiler 7 can be shifted in the direction of the web travel in order to harmonize the zone of over pressure and that of under pressure, as still shall be explained. For this purpose closeable slots 8 can be provided in the top plate 1 in which the spoiler 7 is fixed for instance by bolts and nuts 8*a*. In lieu of a mechanical spoiler 7, a jet spoiler may be used wherein a plurality of transversely arrayed apertures 8*b* may be formed in top plate 1**.

As seen in the travel direction of the web another nozzle aperture 11 is provided behind the spoiler 7 which is formed by the rear straight edge **1*a* of the top plate 1 and the curved front edge of a diffuser sheet 5. The width of the rear nozzle 11 is between 2 mm and 16 mm. The distance of the highest point 5*a* of the diffuser sheet 5 from the material web 13 is less than the distance of the top plate 1 from the material web 13. Departing from point 5*a* the distance of the diffuser sheet 5 from web 13 increases, since the diffuser sheet extends at a small angle from the horizontal in the direction of the base 12**.

For better control of lateral charging of the plenum 10 with the gas, guide baffles 16 are provided beneath nozzle slots 9 and 11. For this purpose flanges 15 and **15*a* are provided to project downwardly from top plate 1 adjacent the nozzle slots 9 and 11, respectively. Between these flanges 15 and 15*a* and the lateral surfaces 14 of the plenum 10 are located the individual guide baffles 16 which are formed by small plates curved toward end plate 13 in their lower portions. The guide baffles 16 are set up in series in the nozzle clearances 9, 11 perpendicularly to the lateral surfaces 14 of the plenum 10**.

In operation, from the nozzle orifice 9 a jet is discharged which strikes the web of material 13 nearly tangentially. Due to the shape of the guide surface 3 the jet is detached from the curved edge **1*b* and top plate 1 and adheres to the guide surface 3. The detachment of the jet from top plate 1 is assisted by the spoiler 7 which tends to confine the jet in the space 17 between the anterior nozzle slot 9 and the spoiler 7. The spoiler 7 obstructs the flowing of the jet from the space 17 by providing a constricted throat 15 between the spoiler 7 and the material web 13 which is narrower than the cross section of the space 17 between the top plate and the material web 13. In the space 17 a gas cushion is therefore formed with higher pressure, which is similar in effect to an air cushion. This air cushion is the more pronounced the smaller the distance of the material web 13 is from the top plate 1, so that as shown in area I of FIG. 2, with a decreasing distance of the material web 13 from the top plate 1** the lifting capacity is extraordinarily increased.

In consequence of the constricted throat 15 caused by the spoiler 7, the flow of gas is accelerated through the throat 15. There is created a pressure drop and the gas emerging from the nozzle slot 11 is thereby accelerated. There is a lower pressure area between the material web 13 and the diffuser sheet 5 which is further reduced to nearly ambient pressure by the diffuser-like widening of the diffuser sheet 5 from the material web 13. This diffuser area is substantially filled by the gas that flows therein from the nozzle slot 11.

In FIG. 2 the pressure distribution over the length of the plenum 10 is shown for several clearances between the material web 13 and the top plate 1. The ranges of high pressure and low pressure are separated from each other by a null point where the pressure curves at 20 mm and 30 mm clearance intersect. It is apparent from this curve that the pressure drops with an increase of the clearance of the material web 13 from the top plate 1, until at about 50 mm clearance the pressure is substantially zero, or under certain circumstances slightly negative. Thus for a large range of weights per unit area of material a state of equilibrium can be established between the material and the plenum by proper selection of jet force and material clearance from the plenum wherein a satisfactory, flutter free guidance of the material can be maintained.

In application, a plurality of plenums are employed, the actual number depending on the distance required to convey the material. By locating the plenums beneath the material and spaced apart from center line to center line between two and three times the cross-sectional width of a plenum the high pressure zone over each plenum and the low pressure zone between each plenum, as shown in FIG. 2, induces in the material a sinusoidal or wave-like motion whereby the material is conveyed from plenum to plenum. This wave-like motion has been found to be quite advantageous in that it prevents canoeing of the material as it is being conveyed. It will be appreciated that this is so because each reversal of position of the material from the trough to peak of the sinusoid inhibits any tendency of the material to canoe between troughs and peaks.

This invention is suitable to convey many types of materials including paper, plastics, textiles and ferrous and non-ferrous metals so long as the unit weight of the material does not exceed the lifting force of the jet. In the preferred embodiment described a nozzle pressure of 1 inch water column with material strip tension in the order of 0.1 kilogram per square mm has proved to be satisfactory. The nozzles in the preferred embodiment are spaced apart approximately 150 mm, and spacing between plenum center lines from 400 to 600 mm has yielded good results.

For certain materials a more positive control of the low pressure area may be desirable. In which case, the plenums may be placed vertically on opposite sides of the material in a staggered relationship whereby both positive and negative pressures will be produced directly by the plenum nozzles in lieu of developing a low pressure zone by virtue of decay of pressure outside of the high pressure zone such as charted in FIG. 2. In this application high and low pressures are only relative terms, both pressures being produced by positive nozzle pressure. With staggered plenums the top plates 1 will be adjacent the material and the bottom plates 12 will be remote from the material as shown in FIG. 3, irrespective of whether a plenum is considered to be relatively above or below the material. In another application the material may be conveyed in a vertical plane when the catenary effect on the material is not objectionable. In this application, of course, the plenums will be positioned horizontally on opposite sides of the material, instead of above and below the material, with the nozzle material relationship of FIG. 3 remaining the same.

It is believed that the invention, its method and apparatus, and its advantages will be understood from the foregoing description, and it is further believed that, while preferred embodiments of the invention have been shown and described for illustrative purposes, the structural details are nevertheless capable of variation within the intent and scope of the invention as defined in the appended claims.

We claim:

1. In apparatus for jet floatation conveyance of strip materials, the improvement in floatation means comprising: a plenum adapted to receive a pressurized gas therein; said plenum having a pair of spaced apart side members; a top flat member spaced intermediate said side members and spaced apart therefrom to define a pair of nozzles therebetween; one edge of said top member being curved downwardly; the top edge of the side member adjacent said top member curved edge extending upwardly and curved inwardly to project over said top member at an acute angle thereto to define an aperture parallel to and greater than the width of the adjacent nozzle; a spoiler exterior of said plenum between said nozzles; the top edge of the other of said side members being curved outwardly away from said top plate and then extending to form an acute angle with said other side portion, and a pair of plates secured to the underside of said top member and projecting downwardly therefrom and parallel to said nozzles; the bottom edges of said plates being curved inwardly.

2. The apparatus of claim 1, including a plurality of curved baffle plates spaced apart and normally secured between said side members and said downwardly projecting plates.

3. The apparatus of claim 1, including means to shift said spoiler longitudinally between said nozzles.

* * * * *